US005465973A

United States Patent [19]

Anderson

[11] Patent Number: 5,465,973

[45] Date of Patent: Nov. 14, 1995

[54] WAR GAME APPARATUS

[76] Inventor: Scott C. Anderson, 2601 Colley Rd. #123, Beloit, Wis. 53511

[21] Appl. No.: 400,502

[22] Filed: Mar. 7, 1995

Related U.S. Application Data

[63] Continuation of Ser. No. 214,096, Mar. 17, 1994, abandoned.

[51] Int. Cl.[6] ..... A63F 3/00

[52] U.S. Cl. ..... 273/262

[58] Field of Search ..... 273/242, 243, 273/248, 249, 255, 262

[56] References Cited

U.S. PATENT DOCUMENTS

| | | |
|---|---|---|
| 4,093,236 | 6/1978 | Hoffa . |
| 4,753,441 | 6/1988 | Braus et al. . |
| 4,902,017 | 2/1990 | Grammatico . |
| 5,020,805 | 6/1991 | Fratangelo et al. . |
| 5,108,112 | 4/1992 | Gould . |

OTHER PUBLICATIONS

Risk, a Board Game, Parker Brothers, pp. 1–7, ©1980.

*Primary Examiner*—William E. Stoll

[57] ABSTRACT

A war game apparatus includes a game board which includes a map. The map depicts an area known as the Middle East and includes land areas and water areas, and a plurality of color coded three-dimensional game pieces which include ships placed on the water areas and which includes a plurality of color coded pieces placed on the land areas. The color coded land area pieces include a plurality of airplanes, a plurality of soldiers, a plurality of free men, a plurality of Scud missiles, a plurality of Scud missiles launchers, a plurality of Tomahawk missiles, and a plurality of Patriot missiles capable of being placed on the land areas. A pair of chance selection devices are provided for determining order of play among players. A plurality of instruction cards are provided for directing play action when a player takes a turn and selects instruction cards. A plurality of color coded territory cards are provided which correspond to color codes of the color coded game pieces. The land areas are designated as States. A Scud missile is capable of symbolically killing twenty percent of the soldiers on a land area it lands upon. A Patriot missile is capable of symbolically defending against a Scud missile and a Tomahawk missile. A Tomahawk missile can be symbolically fired from a ship and is capable of symbolically killing thirty percent of the soldiers on a land area it lands upon. An airplane can be placed on any land area owned by a player.

14 Claims, 4 Drawing Sheets

FIG 1
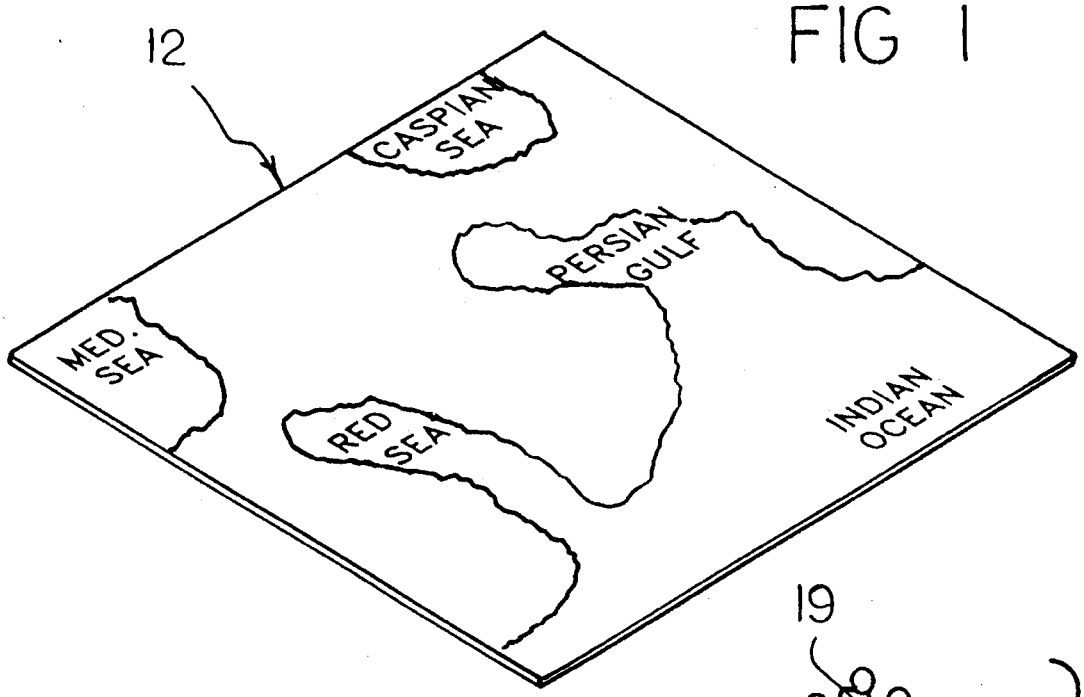
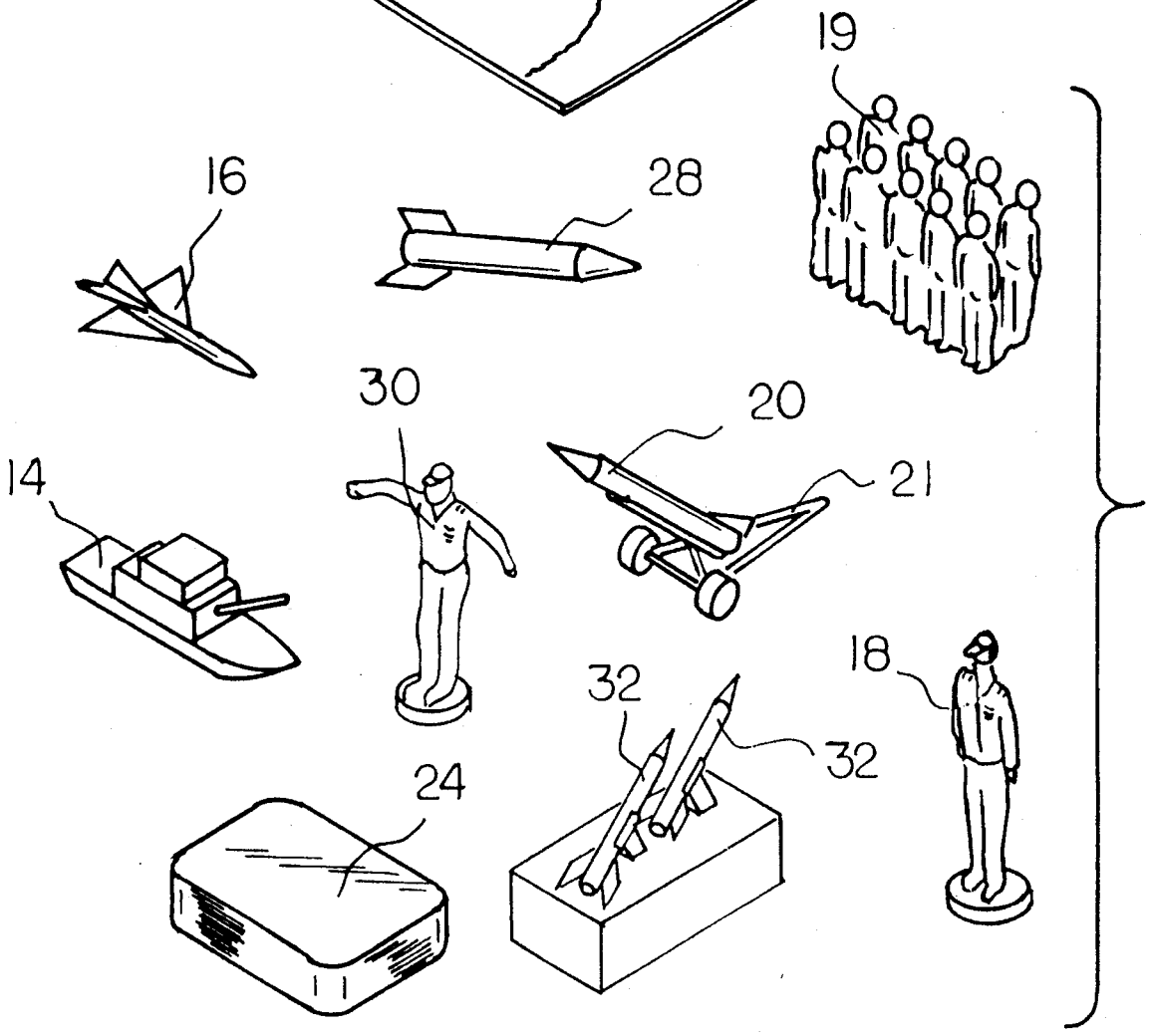
FIG 2

WAR GAME APPARATUS

This application is a continuation of application Ser. No. 08/214,096, filed Mar. 17, 1994, now abandoned.

BACKGROUND OF THE INVENTION

1. Field of the Invention

The present invention relates generally to board games and, more particularly, to board games that simulate war and other military conflicts.

2. Description of the Prior Art

Although history shows that wars have been the most cataclysmic of human activities, there is a pervading interest in war and military conflict during times of both war and peace. This interest is manifested in books, movies, and other media of communication. In addition, throughout the years, a number of board games have been developed relating to war, and the following U.S. patents are representative of some of those board games: U.S. Pat. Nos. 4,093,236; 4,753,441; 4,902,017; 5,020,805; and 5,108,112. More specifically, U.S. Pat. No. 4,093,236 employs a fictitious map for a fictitious territory and relates to a fictitious war. Part of the fascination with war is the simulated refighting of an actual war. In this respect, it would be desirable if a board game were provided which includes a real map for a real territory involved in a real war.

U.S. Pat. Nos. 4,753,441 and 4,902,017 disclose war games that include game boards that include grid patterns on the boards. Although grid patterns may be useful in structuring the play of the game, grid patterns may be deemed a too distant departure from real-world conditions where grid patterns may not exist. In this respect, it would be desirable if a board game were provided which included a game board which were free of grid patterns.

U.S. Pat. No. 5,020,805 discloses a war game which has a theme of the Vietnam war. The game includes simulations of specific features of the Vietnam War such as a jungle, squads of small numbers of men, and prisoner of war camps in which American prisoners were kept. An object of the game is to free prisoners from the prison camps. The most recent war, however, in American history is the Persian Gulf War, not the Vietnam War. Moreover, there are many negative memories of the Vietnam War which was not a clear-cut victory for the United States. In the Persian Gulf War, however, the victory of the United States was clear cut. In this respect, it would be desirable if a board game were provided which relates to the Persian Gulf War in which the United States and its allies were victorious.

U.S. Pat. No. 5,108,112 is a board game that relates to the Persian Gulf War. Specific aspects of the Persian Gulf War are mentioned in the game and included on the game board. For example, the game board makes reference to barrels of oil, to Scud missile attacks, to Patriot missile launches, to bunkers, and to prisoners. The object of the game is to accumulate the most barrels of oil before running out of missiles. Although it is appreciated that this game relates to the Persian Gulf War, there are important features of the Persian Gulf War that are left out of this game. In the Persian Gulf War, the use of manned airplanes was a critical component of victory, yet this game appears to ignore the use of manned airplanes. In this respect, it would be desirable if a board game were provided which simulated the Persian Gulf War and included simulated manned airplanes as part of the game.

In addition, in the Persian Gulf War, sea-launched cruise missiles (such as the Tomahawk) were an important feature of the war. Yet the game in U.S. Pat. No. 5,108,112 does not appear to include sea-launched weapons. In this respect, it would be desirable if a board game were provided which simulated the Persian Gulf War and included simulated sea-based weapons.

Another problem associated with the Persian Gulf War game disclosed in U.S. Pat. No. 5,108,112 is the fact that features of the war are represented on the game board as mere two-dimensional depictions or as mere descriptive words. In this respect, it would be desirable if a board game were provided which included small three-dimensional objects which simulate the real three-dimensional objects involved in the Persian Gulf War. For example, it would be desirable for a Persian Gulf War game to include small, three-dimensional simulated airplanes, boats, Scud missiles, and soldiers.

As stated above, the object of the game in U.S. Pat. No. 5,108,112 is to accumulate the most barrels of oil before running out of missiles. Such an object may be a desirable object in war. However, a more realistic object in war is to conquer territory. In this respect, it would be desirable if a board game were provided which had as its goal the conquest of territory.

Still other features would be desirable in a board game relating to war. For example, to be interesting, a game has a blend of skill and luck. Luck usually enters by the use a chance selection device such as a pair of dice or a spinner. In this respect, it would be desirable if a Persian Gulf War game were provided with a chance selection device such as a pair of dice or a spinner.

Another feature of many games is a random arrangement of instructions. Often a stack of cards are provided which contain instructions. The stack of cards is often shuffled so that the order of the cards is random. In this respect, it would be desirable if a Persian Gulf War game were provided which includes a stack of instruction cards shuffled into a random order.

Another aspect of the Persian Gulf War that was unique to that war was the use of the Patriot anti-missile missile. In this respect, it would be desirable if a board game that simulates the Persian Gulf War be provided with simulated Patriot missiles.

Thus, while the foregoing body of prior art indicates it to be well known to use board games that simulate war, the prior art described above does not teach or suggest a war game apparatus which has the following combination of desirable features: (1) includes a real map for a real territory involved in a real war; (2) includes a game board which is free of grid patterns; (3) relates to the Persian Gulf War in which the United States and its allies were victorious; (4) simulates the Persian Gulf War and includes simulated manned airplanes as part of the game; (5) includes simulated sea-based weapons; (6) includes small, three-dimensional simulated airplanes, boats, Scud missiles, and soldiers; (7) has as its goal the conquest of territory; (8) provides a chance selection device such as a pair of dice or a spinner; (9) includes a stack of instruction cards shuffled into a random order; and (10) provides simulated Patriot missiles. The foregoing desired characteristics are provided by the unique war game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved war game apparatus which includes a game board which includes a map. The map depicts an area known as the Middle East and includes land areas and water areas, a plurality of color coded three-dimensional game pieces which include ships placed on the water areas and which includes a plurality of color coded pieces placed on the land areas. The land area pieces include a plurality of color coded airplanes, a plurality of color coded soldiers, a plurality of color coded free men, a plurality of color coded Scud missiles, a plurality of color coded Scud missiles launchers, a plurality of color coded Tomahawk missiles, and a plurality of color coded Patriot missiles capable of being placed on the land areas. A pair of chance selection devices are provided for determining order of play among players. A plurality of instruction cards are provided for directing play action when a player takes a turn and selects instruction cards. A plurality of color coded territory cards are provided which correspond to color codes of the color coded game pieces.

Containers may also be provided for storing captured soldiers. The land areas are designated as States. The States include Sudan, Iraq, Kuwait, Saudi Arabia, Yemen, Iran, Afghanistan, and Pakistan. The water areas includes the Red Sea and the Persian Gulf. A plurality of color coded ten-soldier squads may also be provided.

A Scud missile is capable of symbolically damaging twenty percent of a land area it lands upon. That is, the Scud missile symbolically kills a predetermined first percentage, e.g. twenty percent, of soldiers on land it lands upon. A Patriot missile is capable of symbolically defending against a Scud missile and a Tomahawk missile. A Tomahawk missile can be symbolically fired from a ship and is capable of symbolically damaging thirty percent of a land area it lands upon. That is, the Tomahawk missile symbolically kills a predetermined second percentage, e. g. thirty percent, of soldiers on land it lands upon. A toy airplane can be placed on any land area owned by a player.

The instruction cards include Scud missile cards, Patriot missile cards, ship cards, airplane cards, Tomahawk missile cards, free men cards, peace cards, and Scud launcher cards.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved war game apparatus which has all of the advantages of the prior art and none of the disadvantages.

It is another object of the present invention to provide a new and improved war game apparatus which may be easily and efficiently manufactured and marketed.

It is a further object of the present invention to provide a new and improved war game apparatus which is of durable and reliable construction.

An even further object of the present invention is to provide a new and improved war game apparatus which is susceptible of a low cost of manufacture with regard to both materials and labor, and which accordingly is then susceptible of low prices of sale to the consuming public, thereby making such war game apparatus available to the buying public.

Still yet a further object of the present invention is to provide a new and improved war game apparatus which includes a real map for a real territory involved in a real war.

Still another object of the present invention is to provide a new and improved war game apparatus that includes a game board which is free of grid patterns.

Yet another object of the present invention is to provide a new and improved war game apparatus which relates to the Persian Gulf War in which the United States and its allies were victorious.

Even another object of the present invention is to provide a new and improved war game apparatus that simulates the Persian Gulf War and includes simulated manned airplanes as part of the game.

Still a further object of the present invention is to provide a new and improved war game apparatus which includes simulated sea-based weapons.

Yet another object of the present invention is to provide a new and improved war game apparatus that includes small, three-dimensional simulated airplanes, boats, Scud missiles, and soldiers.

Still another object of the present invention is to provide a new and improved war game apparatus which has as its goal the conquest of territory.

An even further object of the present invention is to provide a new and improved war game apparatus that provides a chance selection device such as a pair of dice or a spinner.

Still a further object of the present invention is to provide a new and improved war game apparatus that includes a stack of instruction cards shuffled into a random order.

Yet another object of the present invention is to provide a new and improved war game apparatus which provides simulated Patriot missiles.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of a real-map-containing game board of the war game apparatus of the invention.

FIG. 2 is a perspective view of an array of three-dimensional game pieces that are part of the war game apparatus of the invention.

DESCRIPTION OF THE PREFERRED EMBODIMENT

With reference to the drawings, a new and improved war game apparatus embodying the principles and concepts of the present invention will be described.

Figure 3:
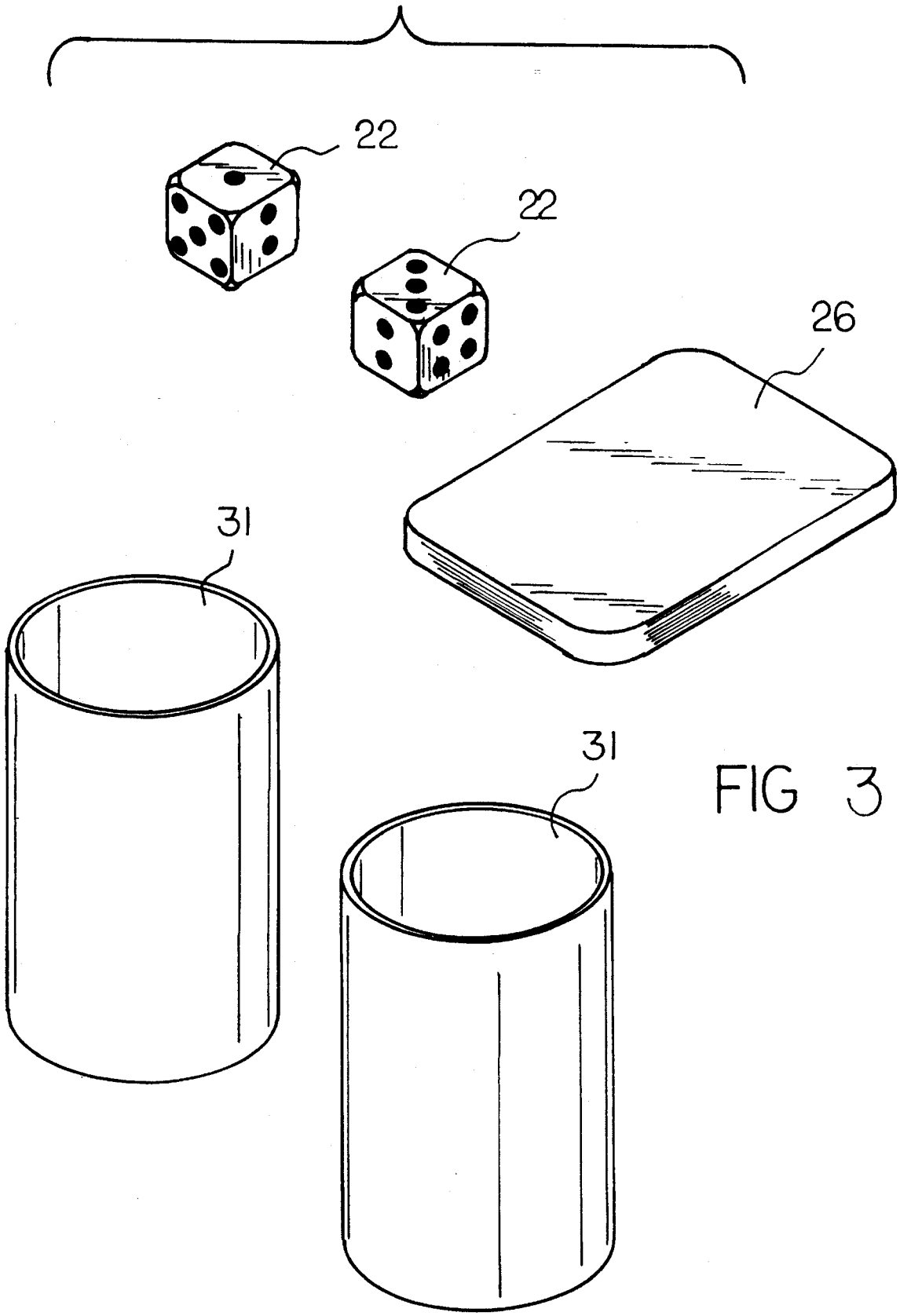
FIG. 3 is a perspective view of an array of components of the war game apparatus of the invention which relate to chance selection or random instructions.
Figure 4A:
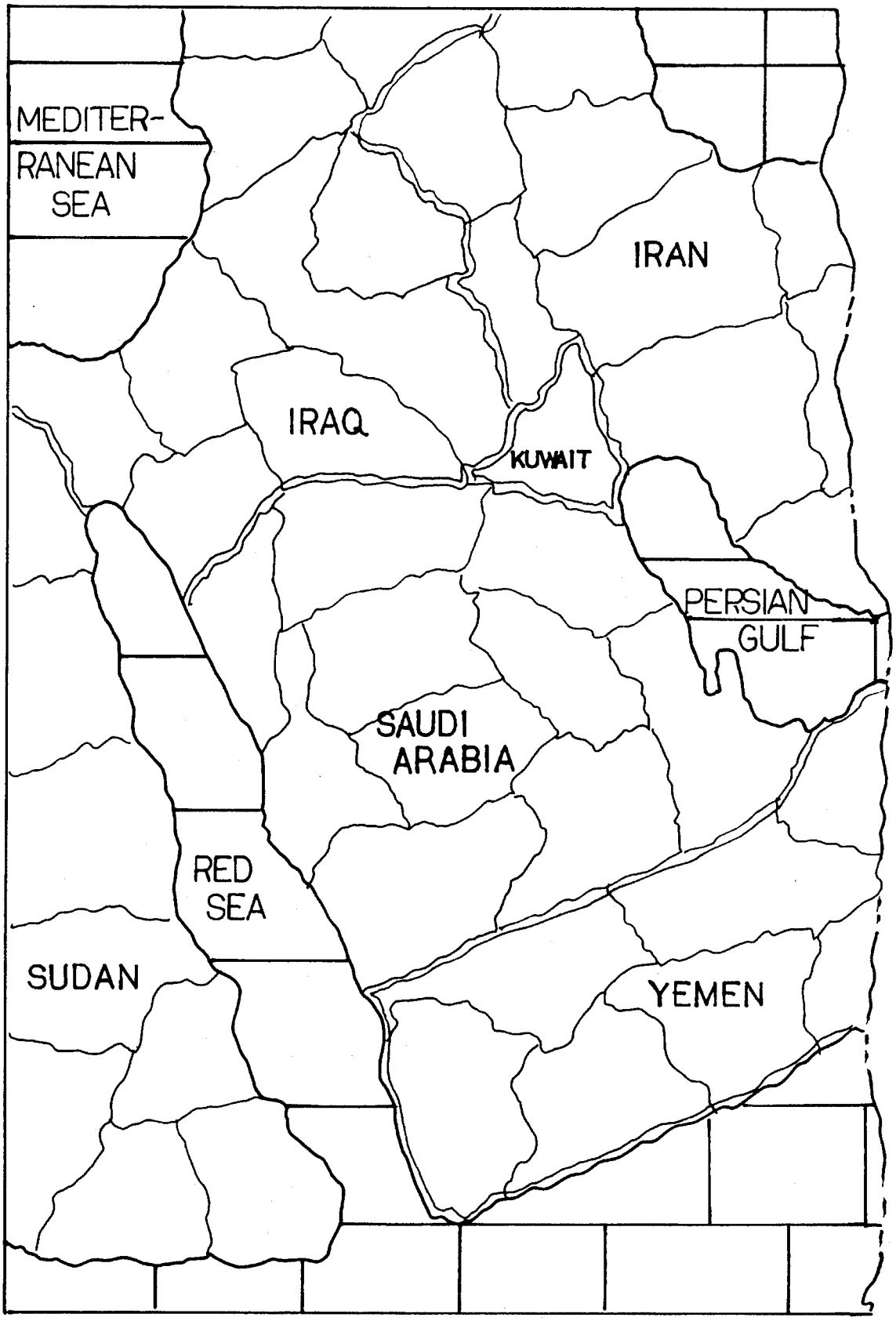
FIG. 4A is an enlarged top view of a western half of the game board shown in FIG. 1 a perspective view of a second embodiment of the invention.
Figure 4B:
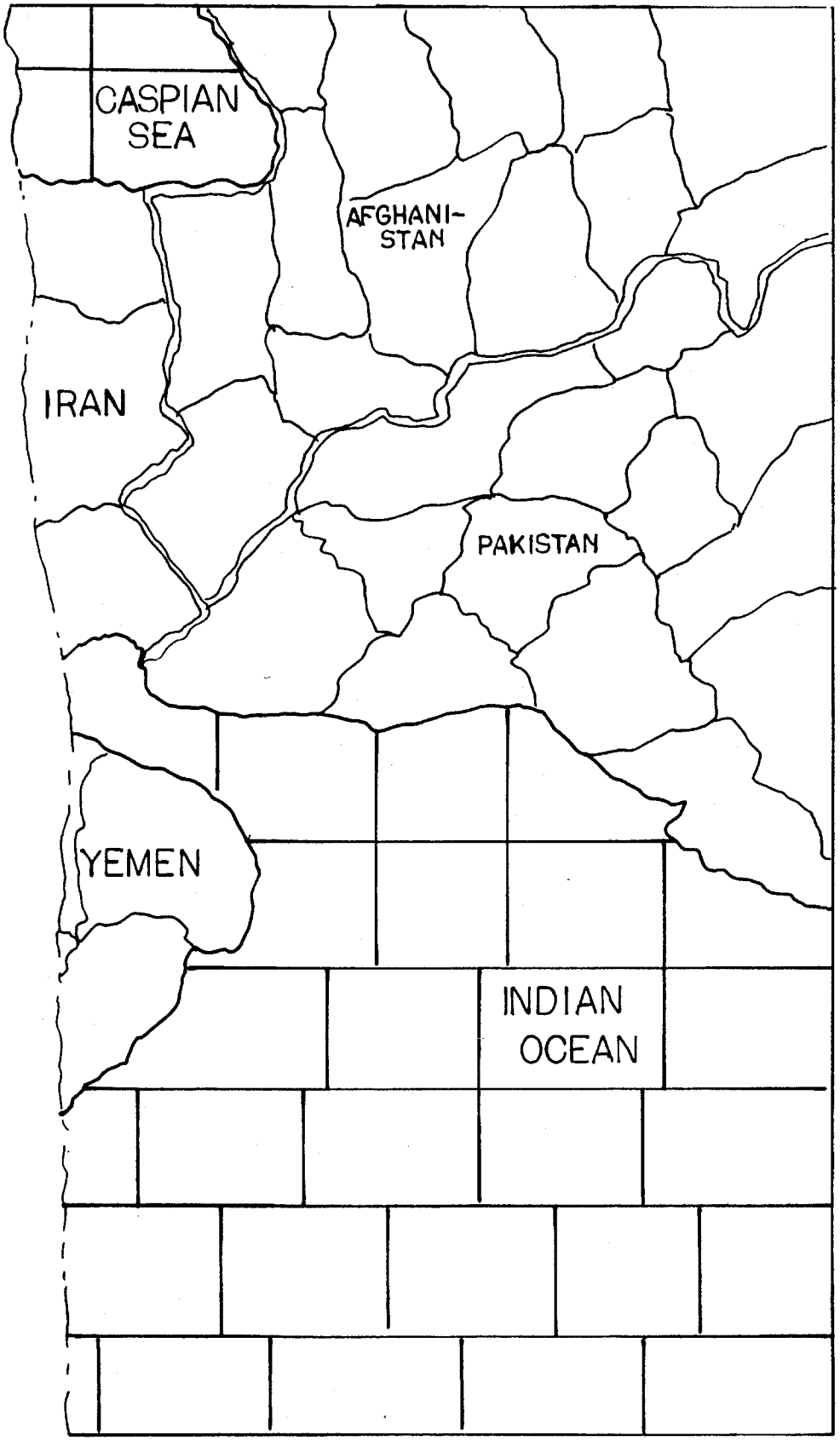
FIG. 4B is an enlarged top view of an eastern half of the game board shown in FIG. 1.

Turning to FIGS. 1–4B, there is shown an exemplary embodiment of the war game apparatus of the invention. In its preferred form, the war game apparatus includes a map. The map depicts an area known as the Middle East and includes land areas and water areas, a plurality of color coded three-dimensional game pieces which include ships 14 placed on the water areas and which includes a plurality of color coded pieces placed on the land areas. The land area pieces include a plurality of color coded airplanes 16, a plurality of color coded soldiers 18, a plurality of color coded free men 30, a plurality of color coded Scud missiles 20, a plurality of color coded Scud missiles launchers 21, a plurality of color coded Tomahawk missiles 28, and a plurality of color coded Patriot missiles 32 capable of being placed on the land areas. A pair of chance selection devices 22 which may includes two dice 22 are provided for determining order of play among players. A plurality of instruction cards 24 are provided for directing play action when a player takes a turn and selects instruction cards 24. A plurality of color coded territory cards 26 are provided which correspond to color codes of the color coded game pieces.

Containers 31 may also be provided for storing captured soldiers 18. The land areas are designated as States. The States include Sudan, Iraq, Kuwait, Saudi Arabia, Yemen, Iran, Afghanistan, and Pakistan. The water areas includes the Red Sea and the Persian Gulf. A plurality of color coded ten-soldier squads 19 may also be provided.

A Scud missile 20 is capable of symbolically damaging twenty percent of a land area it lands upon.

That is, the Scud missile 20 symbolically kills a predetermined first percentage of twenty percent of soldiers 18 on land it lands upon. Sybolic killing can be manifested by simply knocking soldiers over or removing them from the game board. A Patriot missile 32 is capable of symbolically defending against a Scud missile 20 and a Tomahawk missile 28. A Tomahawk missile 28 can be symbolically fired from a ship 14 and is capable of symbolically damaging thirty percent of a land area it lands upon. That is, the Tomahawk missile 28 symbolically kills a predetermined second percentage of thirty percent of soldiers 18 on land it lands upon. An airplane 16 can be placed on any land area owned by a player.

The instruction cards 24 include Scud missile cards, Patriot missile cards, ship cards, airplane cards, Tomahawk missile cards, free men cards, peace cards, and Scud launcher cards.

The object of the game is to own and rule all of the territory on the map of the game board 12. To begin play. Each player starts with 2 ships 14, 2 airplanes 16, 20 soldiers 18, 1 Scud missile launcher 20, and 2 instruction cards 24. In total, the war game apparatus of the invention includes 112 airplanes 16 with 16 airplanes in each of 7 colors. There are 112 ships 14 with 16 ships in each of 7 colors. There are 112 Scud missile launchers 20 with 16 Scud missile launchers in each of 7 colors. There are 112 ten-soldier squads 19 with 16 ten-soldier squads 19 in each of 7 colors. There are 224 single soldiers 18 with 32 single soldiers 18 in each of 7 colors.

With respect to the instruction cards 24, there are 5 which provide for one Scud missile 20. The Scud missile card entitles the holder to one Scud missile 20 which can be fired from a Scud missile launcher 21 and must be used at the beginning of their turn. The Scud missile 20 has a maximum range of three spaces from the Scud missile launcher 21. A Scud missile 20 does damage to the extent of 20% to the State that it lands upon.

There are 5 instruction cards 24 which provide for one Tomahawk missile 28. The Tomahawk missile 28 card entitles the holder to one Tomahawk missile 28 which can be only fired from a ship 14 and must be used at the beginning of a turn. The Tomahawk missile 28 has a maximum range of 4 spaces from the ship 14 that fired it, and it inflicts 30% damage to the State that it lands upon.

There are 7 instruction cards 24 which provide for 5 free men 30. The free men 30 card entitles the holder to 5 free men 30. These free men 30 can be placed in any State that the holder of the card owns, or the free men 30 can be divided up and put on many States. This card must be played at the beginning of the player's turn.

There are 7 instruction cards 24 which provide for 1 airplane 16. The airplane 16 card entitles the holder to 1 airplane 16 which can be placed on any State that the holder owns. The card must be played at the beginning of a turn.

There are 7 instruction cards 24 which entitle the holder to one ship 14. The ship 14 card must be placed on a segment of water that borders a State owned by the card holder.

There are 7 instruction cards 24 which provide for 1 Scud missile launcher 21. The Scud missiles launcher card entitles the holder to 1 Scud missiles launcher 21 which can be placed on any State that the holder of the card owns. This card must be played at the beginning of a turn.

There are 5 instruction cards 24 which provide for 1 Patriot missile 32. The Patriot missile card entitles the holder to one Patriot missile 32. The card is only for defense when another player fires a Scud missile 20 or a Tomahawk missile 28 at one of the card holder's States. The Patriot missile card can be used only once for defense of one missile and must then be discarded. The card can be played at anytime throughout the game.

In addition, there are 5 instruction cards 24 which provide for 3 rounds of peace. The peace card entitles the holder to 3 rounds of peace. When this card is played, it forces peace on one player of the holder's choice for three rounds. That player must not attack the card holder for three rounds of play. The card must be played at the beginning of a turn.

In accordance with the invention, the pieces move in the following ways. Single soldiers 18 can move one space in any direction. An airplane 16 can move in any direction up to 3 spaces. A ship 14 can move in any direction up to 3 spaces as long as it stays in water. A Scud missile launcher 20 can move one space in any direction. It is noted that any amount of pieces may be on a State at any time except during war. It is noted that when a player moves pieces, the player can move all or one from one state. The player may do this 3 times in one turn. Pieces can be moved to unclaimed States to claim or move them. A player can have as many men on a State as the player wants. Similarly. A player can have as many ships 14, airplanes 16, and Scud missile launchers 20 on a State as desired.

The destructive power of different weapons vary from one another. This fact is reflected in the war game apparatus of the invention wherein different weapons are assigned different equivalent values for the amount of men they equal. More specifically, 1 airplane 16 is equal to 3 single soldiers 18. One ship 14 is equal to 4 single soldiers 18. One Scud missile launcher 20 is equal to 3 single soldiers 18. For example, if a player has 1 airplane 16, 1 Scud missile launcher 20, and 4 single soldiers 18 on a State, the player has the equivalent of a total of 10 single soldiers 18.

A player obtains the free men 30 at the beginning of every turn. To determine how many free men 30 are obtained. A player counts up all the States that the player owns. If the player owns 5 or less States, the player gets 1 free man 30 at the beginning of a turn. If the player owns 6 to 10 States, the player gets 2 free men 30. If the player owns 11 to 15 States, the player gets 3 free men 30. If a player owns 16 or more States, the player gets a maximum of 4 free men 30. In order to own a State, the player must have at least 1 piece on the State, and the piece can be any piece. It is noted that water squares are not counted as States.

In playing the game, each player picks a color of pieces to use. The player only uses pieces of the chosen color. There are seven territory cards, each one a different color. The seven cards are mixed up, and each player picks one card. The card indicates what territory that a player owns. The player places one's pieces on one's State with ships in the water. The pieces are distributed over the owned States as desired. Each player rolls one die 22 to see who goes first. The high person starts the play of the game.

One person deals two instruction cards 24 to each player. The player who starts draws on instruction card 24 or enough instruction cards 24 to make three. Then a player collects one's free men 30. Each player can do three things in one's turn such as play all cards or one card, one move, or one attack, or any combination of them. Once an attack is initiated on a State, that State is continued to be attacked until the State is won, the State is lost, or the attacker decides to quit the attack.

During a turn, attacking a State is one of the three things that a player is allowed to do during a turn, and the player can attack up to three States during one turn. Alternatively, the player need not take any action during a turn. If desired, the player can just take the free men 30 and draw instruction cards 24. Also, the player can simply pass if desired.

Another action allowed during a player's turn is moving one of the player's single soldiers 18 from one State to another State. Three soldiers can be moved to one time each, or one soldier can be moved three times. All instruction cards 24 must be played at the beginning of a turn with the exception of a Patriot missile card which can be played at any time.

If a player chooses to attack a State, the attacker takes one die 22 and the player that is attacked takes one die 22. Both players roll their respective die 22, and the player with the lower die number wins the roll and takes one single soldier 18 off of his State. The player may store captured pieces from other players in a storage cup. The process of the game proceeds until a player has no more single soldiers 18 on a State or until an attacker wants to quit. It is noted that no player can move single soldiers 18 into their States when in battle. If there is a tie on the roll of the dice 22, the defending player takes the turn.

When a player attacks with an airplane 16, the player must take at least three single soldiers 18 with the airplane 16. The player flies to the State that is to be attacked up to three spaces away. The fighting is the same as a ground fight except that when the single soldiers 18 of the airplane 16 are gone, the airplane 16 must retreat to the State from which it originated. When the airplane 16 is attacking, it cannot be destroyed. The airplane 16 can be destroyed only when it is attacked.

If a player makes an attack by a ship 14, the rule is similar to an attack with an airplane 16 except that the attack can only be on States that are next to water or other ships 14.

If at the beginning of a turn a player decides to play one's instruction cards 24, the cards are played one at a time.

If a player plays a Scud missile card, the player announces what State the player is firing from and what State is the target of the Scud missile attack. The player who owns the State is attacked will announce whether or not the player has a Patriot missile card or not. If the State under Scud attack has no Patriot missiles to defend itself, then when the State is hit by the Scud missile, 20% of the single soldiers 18 in the State will be killed by the Scud missile and are removed from the State. If there are less than 5 single soldiers 18 on the State, then 1 single soldier 18 is killed by the Scud missile. Scud missiles 20 can only be fired from a Scud missiles launcher 21 which has a maximum range of 0–3 spaces.

If a player uses a Tomahawk missile 28, the effects are the same as that with a Scud missile 20, with the exception that the Tomahawk missile 28 has a range of from 0–4 spaces and can only be fired from a ship 14. If a player plays either a Scud card or a Tomahawk card and the opponent has a Patriot card, then both cards become dead and are put back into the pile of instruction cards 24.

Generally, all instruction cards 24 are played only once and returned to the pile of instruction cards 24. The play described above goes back and forth until a player has no more pieces or States. The player who remains after all other players are defeated is the winner.

The components of the war game apparatus of the invention can be made from inexpensive and durable paper and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved war game apparatus that is low in cost, relatively simple in design and operation, and which advantageously includes a real map for a real territory involved in a real war. With the invention, a war game apparatus is provided which includes a game board which is free of grid patterns. With the invention, a war game apparatus is provided which relates to the Persian Gulf War in which the United States and its allies were victorious. With the invention, a war game apparatus is provided which simulates the Persian Gulf War and includes simulated manned airplanes as part of the game. With the invention, a war game apparatus is provided which includes simulated sea-based weapons. With the invention, a war game apparatus is provided which includes small, three-dimensional simulated airplanes, boats, Scud missiles, and soldiers. With the invention, a war game apparatus is provided which has as its goal the conquest of territory. With the invention, a war game apparatus is provided with a chance selection device such as a pair of dice or a spinner. With the invention, a war game apparatus is provided which includes a stack of instruction cards shuffled into a random order. With the invention, a war game apparatus is provided with simulated Patriot missiles.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A method of playing a war game comprising the steps of:

(a) providing a map divided into a plurality of spaces, the spaces including state spaces and water spaces;

(b) providing a plurality of color coded game pieces, the plurality of color coded game pieces including ships placed on the water spaces and land pieces placed on the state spaces, the land pieces including: a plurality of airplanes; a plurality of soldiers; a plurality of Scud missiles; a plurality of Scud missile launchers; a plurality of Tomahawk missiles; and a plurality of Patriot missiles.

(c) providing a pair of chance selection devices (d) providing a plurality of instruction cards for directing play action when a player takes a turn;

(e) assigning a color to each player;

(f) assigning a plurality of soldiers, and a plurality of instruction cards to each player;

(g) initially awarding to each player and positioning a plurality of soldiers upon a plurality of state spaces of the map;

(h) awarding a player a plurality of soldiers at a beginning of a turn;

(i) drawing a plurality of instruction cards by a player, the player doing one of the steps selected from the group consisting of: passing play to another player; attacking an opposing player; and moving a soldier from one state space to another state space wherein the player is entitled to a predetermined total of soldier-space moves defined as a number of soldiers moved multiplied by a number of spaces moved;

wherein a state space is owned by a player having at least one land piece on the state space.

2. The method of playing a war game of claim 1, wherein the soldiers awarded in step (h) are awarded as follows: if the player owns within a first range of state spaces, the player gets a first number of free men at the beginning of a turn; if the player owns within a second range of state spaces, the player gets a second number of free men; if the player owns within a third range of state spaces, the player gets a third number of free men; if a player owns within a fourth range of state spaces, the player gets a fourth number of free men.

3. The method of playing a war game of claim 1, wherein the instruction cards include a plurality of Scud missile launcher instruction cards which award at least one Scud missile launcher to the player of a Scud missile launcher instruction card, the Scud missile launcher being positionable only on a state space that the player of the Scud missile launcher instruction card owns; and further wherein the instruction cards include a plurality of Scud missile instruction cards which award at least one Scud missile to the player of a Scud missile instruction card, the Scud missile being positionable only on a state space owned by the player of the Scud missile instruction card having a scud missile launcher positioned therein.

4. The method of playing a war game of claim 3, wherein the instruction cards include a plurality of ship instruction cards which award at least one ship to the player of a ship instruction card, the ship being positionable only on a water space that borders a state space owned by the player of the ship instruction card; and further wherein the instruction cards include a plurality of Tomahawk missile instruction cards which award at least one Tomahawk missile to the player of a Tomahawk missile instruction card, the Tomahawk missile being positionable only on a water space that borders a state space owned by the player of the Tomahawk missile instruction card having a ship positioned therein.

5. The method of playing a war game of claim 4 wherein the instruction cards include a plurality of airplane instruction cards which award at least one airplane to the player of a airplane instruction card, the airplane being positionable only on a state space owned by the player of the airplane instruction card.

6. The method of playing a war game of claim 5, wherein the instruction cards include a plurality of Patriot missile instruction cards which award at least one Patriot missile to the player of a Patriot missile instruction card.

7. The method of playing a war game of claim 6, wherein the instruction cards include a plurality of peace instruction cards which provide for at least one round of peace wherein the player of a peace instruction card can force peace on an opposing player for at least one round of play such that the opposing player cannot attack the player of the peace instruction card.

8. The method of playing a war game of claim 7, wherein step (g) further comprises providing a plurality of territory cards; drawing one of the territory cards by each player, wherein the territory card indicate a predetermined number of state spaces; and awarding the player the predetermined number of state spaces, whereby the player can initially position the player's land pieces onto the awarded state spaces and initially position the player's ships onto the water spaces adjacent to the awarded state spaces.

9. The method of playing a war game of claim 8, wherein the step of attacking an opposing player comprises the steps of: an attacking player taking one of the chance selection devices and the opposing player taking another one of the chance selection devices, the attacking player and the opposing player each generating a random number through the respective chance selection devices, wherein one of the attacking and opposing players having a random number of a predetermined difference from a random number of another one of the attacking and opposing players must remove a soldier from a predetermined one of the state spaces; the attacking continuing until a condition selected from the group consisting of: the attacking player terminates attacking, and the predetermined state space of the attacking or opposing player is absent of soldiers;

10. The method of playing a war game of claim 9, wherein the step of attacking an opposing player further comprises the step of: an attacking player moving a plurality of soldiers and one airplane to the predetermined state space of the attacking player.

11. The method of playing a war game of claim 9, wherein the step of attacking an opposing player further comprises the step of: an attacking player moving a plurality of soldiers and one ship to a water space adjacent to the predetermined state space of the attacking player.

12. The method of playing a war game of claim 8, wherein the step of attacking an opposing player comprises the steps of: playing a Scud missile card by announcing a state space the player of the Scud missile card is firing a Scud missile from and a state space designated as a target of the Scud missile; announcing by the player owning the state space designated as the target of the Scud missile a possession of a Patriot missile card, wherein if the player owning the state space designated as the target of the Scud missile does not posses a Patriot missile card, then a predetermined number of soldiers are removed from the state space designated as the target of the Scud missile.

13. The method of playing a war game of claim 8, wherein the step of attacking an opposing player comprises the steps of: playing a Tomahawk missile card by announcing a state space the player of the Tomahawk missile card is firing a Tomahawk missile from and a state space designated as a target of the Tomahawk missile; announcing by the player owning the state space designated as the target of the Tomahawk missile a possession of a Patriot missile card, wherein if the player owning the state space designated as the target of the Tomahawk missile does not posses a Patriot missile card, then a predetermined number of soldiers are removed from the state space designated as the target of the Tomahawk missile.

14. The method of playing a war game of claim 1, wherein the map depicts an area of the world known as the Middle East, with the state spaces being shaped so as to resemble the Countries of Sudan, Iraq, Kuwait, Saudi Arabia, Yemen, Iran, Afghanistan, and Pakistan, and the water spaces being shaped so as to resemble the bodies of water of the Red Sea and the Persian Gulf.

* * * * *